United States Patent [19]

Gugel et al.

[11] Patent Number: 5,074,687

[45] Date of Patent: Dec. 24, 1991

[54] ARMATURE OF AN ELECTROMAGNET-COIL/ARMATURE SYSTEM FOR DOT MATRIX PRINT HEADS, AND METHOD OF MANUFACTURING SAME

[75] Inventors: Bernd Gugel, Ulm-Einsingen; Johann Stempfle, Pfaffenhofen; Matthias Ullrich, Albeck, all of Fed. Rep. of Germany

[73] Assignee: Mannesmann Aktiengesellschaft, Dusseldorf, Fed. Rep. of Germany

[21] Appl. No.: 342,453

[22] Filed: Apr. 21, 1989

[30] Foreign Application Priority Data

Apr. 22, 1988 [EP] European Pat. Off. ..... 88730094.5

[51] Int. Cl.[5] ..... B41J 3/12

[52] U.S. Cl. ..... 400/124; 101/93.05

[58] Field of Search ..... 400/124; 101/93.05; 29/609

[56] References Cited

U.S. PATENT DOCUMENTS 3,202,851 8/1965 Zimmerle et al. ..... 29/609

4,264,663 4/1981 Beenken ..... 29/609

4,538,345 9/1985 Diedericks ..... 29/609

4,674,897 6/1987 West et al. ..... 400/124

4,881,832 11/1989 Mitsuishi et al. ..... 400/124

*Primary Examiner*—Edgar S. Burr

*Assistant Examiner*—Ren Yan

*Attorney, Agent, or Firm*—Cohen & Pontani Lieberman

[57] ABSTRACT

In a method for the manufacture of armatures from sheet-metal parts stacked in the manner of laminated inductors, predeterminately shaped openings or indentations (6) and corresponding coaxially opposite projections (8) are defined in and during the formation of the sheet-metal parts (1, 2, 3), the sheet-metal parts are stacked so that the projections (8) nestedly engage the shaped openings or indentations (6) of the adjacent sheet-metal part (1, 2, 3) and thereby provide form-locked mechanical connections between the parts, and the stack (11) of sheet-metal shapes is secured against loosening and disengagement of the form-locked mechanical connections (10) by cementing or thermal bonding or the like of the sheet-metal parts one to another.

12 Claims, 1 Drawing Sheet

ARMATURE OF AN ELECTROMAGNET-COIL/ARMATURE SYSTEM FOR DOT MATRIX PRINT HEADS, AND METHOD OF MANUFACTURING SAME

FIELD OF THE INVENTION

The present invention relates to a method for producing armatures of the electromagnet-coil/armature system for dot matrix print heads, and to an improved armature, particularly but not exclusively of the flap armature type, formed of shaped sheet metal parts or elements which are stacked in the manner of a laminated inductor.

BACKGROUND OF THE INVENTION

Dot matrix print heads form a central assembly on which the performance of a dot matrix printer depends. The type of construction and materials employed and the resulting performance characteristics of the print head determine the endurance, and thus the life, of the printer. Dot matrix print heads are typically replaceable in the printer and are accordingly available as spare parts therefor. The performance characteristics of the print head are substantially determined by the system or arrangement of the magnetic circuit, i.e. of the electromagnet-coil/armature system. In this connection a distinction may be drawn between so-called pretensioned magnet systems, in which the armature consists of a spring, and electromagnet-coil/armature systems of the flap armature type.

The present invention relates to the construction and production of either of these two types of armature, although its preferred application—and that to which the present disclosure is specifically directed—is to systems of the flap armature type. In any event, the magnetic induction produced by the electromagnet coil in the magnet core passes in a pulsating manner through the armature. In armatures consisting of a homogeneous ferrous material, the induced voltages thereby produce eddy-current losses since the armature acts in the manner of a short-circuited winding. These eddy-current losses contribute to significant heating of the armature, causing undesired heating of the dot matrix print head and, in addition, to less efficient and effective utilization of energy. This is particularly disadvantageous in that other components or elements present in the dot matrix print head assembly, including the print head itself, are also heated. Not infrequently the resulting temperatures amount to more than 100° C.

It is known that such eddy-current losses can be minimized, or at least significantly reduced, by subdividing the iron body into a multiplicity of thin sheets of material which are insulated from each other (as, for example, by a unilateral paper coating or by surface lacquering) and through the use of silicone-containing iron which has a higher electrical resistance (e.g. alloy dynamo sheets).

When using such laminations on armatures or flap armatures for dot matrix print heads, the relatively small dimensions—such, for example, as an armature length of about 25 mm and an armature thickness of about 6 mm—of the parts necessarily require new manufacturing techniques. Thus, the use of laminated armatures requires a secure connection of the lamellae since the resulting structure, in contradistinction to stationary devices or machines such as transformers or to the stators of electrical machines or of uniformly moving electrical apparati, operatively undergo relatively high forces of acceleration and deceleration in each cycle of armature action.

It has heretofore been proposed, for example in European Patent Application No. A1-0 152 117, that the stacked sheet-metal parts or elements be connected to each other by way of rivets. Because of the small dimensions of the armature assembly, however, rivets are difficult to handle, add excessive weight to the armature and add substantial expense to unit manufacturing costs.

SUMMARY OF THE INVENTION

It is accordingly the object of the invention to provide a laminated-type armature and a method of producing such armatures, incorporating between its sheet-like parts or elements a substantially permanent connection having an effective lifetime of, by way of example, as much a 500 million work cycles with the armature being of light weight and relatively smooth along its exterior surface.

These and other objects are achieved in accordance with the invention by practicing the successive method steps of:

a) forming, simultaneously or substantially concurrently with stamping of the plural sheet-metal elements or armature parts, at least one predeterminately shaped opening or indentation in the outer surface of the first and each succeeding sheet-metal part, and at least one projection, opposite said opening or indentation, in the outer surface of each of the second and subsequent sheet-metal parts, each such projection on a sheet-metal part being predeterminately shaped so as to fit nestedly into the shaped opening of an adjacently-disposed sheet-metal part;

b) stacking the sheet-metal parts such that the shaped opening or indentation in each part and the shaped projection of the adjacently-disposed sheet-metal part in each case define a form-locked mechanical connection between those adjacent parts; and c) securing together the sheet-metal elements or parts in the stack against loosening of the formed-locked mechanical connection by cementing or thermal bonding or welding or the like.

The predeterminately-shaped openings, indentations and projections are effective to assure and maintain precise relative positioning of the plural sheet-metal parts and thus the contour of the entire armature. In addition, an interlocking form-locked connection is produced by a continuous process which includes all manufacturing steps. The mechanical form-lock is thereupon secured against disengagement or release in the finished armature by a nondetachable connection of all of the sheet-metal parts. The resulting armature accordingly possesses the advantageous properties of a stack and is, advantageously, not unduly subject to the heretofore common heating resulting from eddy-current losses. Furthermore, the armature of the invention has a relatively smooth or unbroken pole surface.

As a further improvement in accordance with the invention the thermal bonding between each two adjacently-disposed sheet-metal parts may be effected spotwise—i.e. by spot welding or the like—in the region of the outer surfaces of the adjoining sheet-metal parts. In providing the substantially permanent or nondetachable connections the insulated or uninsulated sheet-metal parts may be separated by a narrow air gap.

Another improvement of the invention contemplates the placement of the thermal bonding or cementing at surface areas which, during operation of the electromagnet-coil/armature system, lie outside of areas of contact with one or more electromagnet coil cores. The provision of such nondetachable connection does not, therefore, disturb the contacting function of the armature and neither does it negatively influence or interfere with the path of armature movement.

The armature thus manufactured in accordance with the invention may furthermore be shaped so that the section of the armature opposite one pole surface of an associated electromagnet coil core is thicker, as compared to another section facing or carrying a print element, and so that the form-locked mechanical connection between adjacently-disposed parts is provided in this thicker section. At least one or two of the sheet-metal parts may form the armature arms on which the print element is carried or fastened.

The armature produced as herein described may, with respect to a limiting sheet-metal shape which keeps the armature relatively smooth or unbroken on its exteriorly-disposed surface, be entirely punched through at its shaped openings in such manner that the outermost sheet-metal shape has continuous shaped throughbores or openings into which the projections of the next inner or immediately adjacent sheet-metal part in the stack engage.

Further objects, features and advantages of the present invention will be more fully appreciated by reference to the following detailed description of presently preferred, but nevertheless illustrative, embodiments in accordance with the invention when taken in conjunction with the accompanying drawings. It is to be understood, however, that the drawings are designed solely for the purpose of illustration and not as a definition of the limits of the invention, for which reference should be made to the appended claims.

BRIEF DESCRIPTION OF THE DRAWINGS

In the drawings, wherein similar reference characters denote similar elements throughout the several views:

FIG. 1 is an elevated perspective view of the plural sheet-metal parts or elements which form the armature of the invention punched out or otherwise formed one after the other in a sequential cutting tool or the like;

DETAILED DESCRIPTION OF THE PREFERRED EMBODIMENTS

Figure 1:
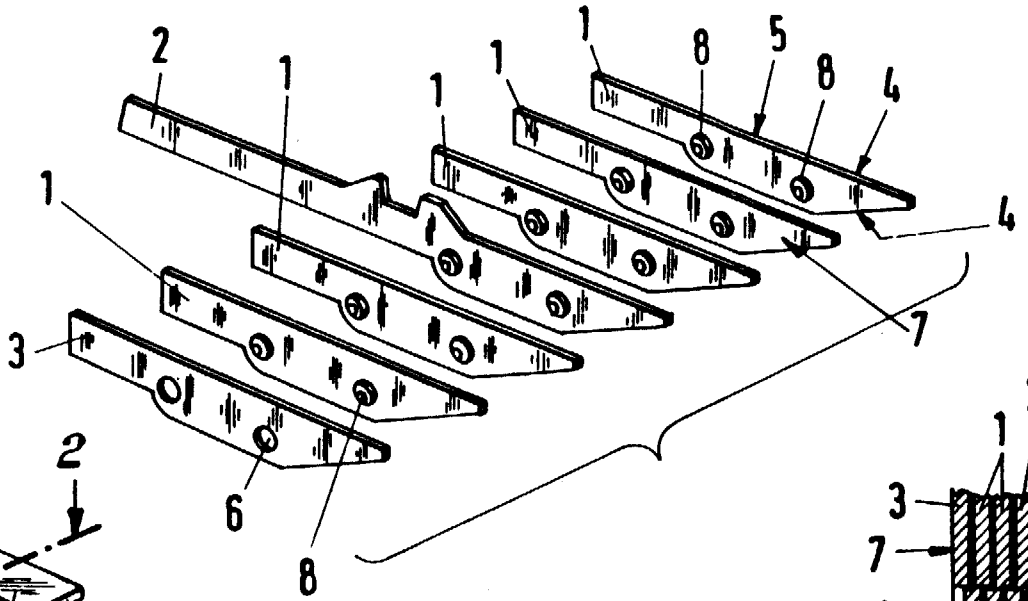
Figure 2:
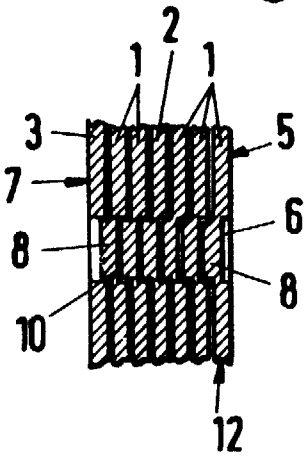
FIG. 2 is a sectional view taken along the lines II—II in FIG. 3.
Figure 3:
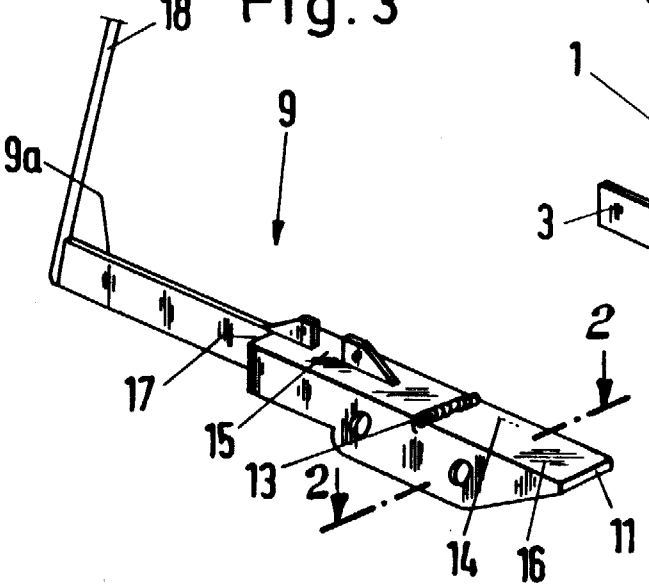
FIG. 3 is an elevated perspective view of a completed armature in accordance with the invention.

The individual sheet-metal parts or elements or members 1, 2, 3 having the appropriate outer shapes or contours 4 such, by way of example, as are depicted in the drawings herein are punched out or otherwise formed by, for example, a sheet metal stamping tool. At the same time, one or more predeterminately shaped openings or indentations 6 are formed or defined in a first face or surface 5 of each sheet-metal part. The indentations 6 in the part 3 may comprise a continuous throughbore extending between the opposite faces thereof. In each of the parts 1 and 2, on the other hand, each opening 6 is defined not as a continuous throughbore but, rather, as an indentation or depression or concavity 6 in the face 5. Also formed in each part 1, 2—preferably also simultaneously or substantially concurrently with the stamping of those parts—is at least one projection 8 which extends outwardly from the second or opposite face or surface 7 of the sheet-metal part aligned substantially coaxially with a corresponding indentation 6. In size, cross-sectional configuration and manufacturing tolerances each projection 8 is such that it fits nestedly into a shaped opening or indentation 6 of an adjacently-disposed sheet-metal part 1, 2 or 3, thereby creating a form-locked mechanical connection between each two adjacently-disposed sheet-metal parts (FIGS. 1 and 2). This element-to-element mechanical connection of the plural sheet-metal parts 1, 2, 3 results, when the elements are so stacked atop each other, in a complete armature 9 (FIG. 3).

It should be understood that although the openings or indentations 6 and the projections 8 are illustrated in the drawings as having generally circular cross-sectional configurations, such configurations are by way of example only and are not intended to be construed as a limitation on the scope of the invention. Thus, the shapes of the indentations or openings 6 and of the projections 8 may be predetermined or selected as a matter of design choice.

In a presently preferred construction, each part or element 1, 2, 3 includes two projections 8 and, correspondingly, two shaped openings or indentations 6 in the longitudinal direction of the armature 9. The totality of openings or indentations 6 and of projections 8 results in an integrated form-locked mechanical connection 10 (FIG. 2) between the plural parts in the stack and provides precise relative alignment and positioning of the parts and, therefore, of the overall contour of the armature 9.

The armature 9 (FIG. 3) accordingly consists of a stack 11 of sheet-like parts—much in the manner of a body formed of a series of parallel slices—which is held together by, for example, adhesive or cement, thermal bonding or welding or other thermal method. Thermal bonding may, for example, be effected spot-wise (i.e. by spot welds) between each two adjacent sheet-metal parts 1 and 2, or 2 and 2, or 2 and 1, or 1 and 3, respectively. This procedure may result in the provision and maintenance of an air gap 12 between portions of adjacent-disposed parts; such air gap, while present in practice, is negligibly small. The successive bonding spots or points in the region of the outer surfaces 5 and 7 of the sheet-metal parts 1, 2, 3 produces the row of melt spots 13 visible in FIG. 3, which row of melt spots may be compared to a weld seam.

The row of melt points 13 is advantageously situate between the mechanical form-locked connections 10 in a surface area 14 which, in operation, lies outside or spaced from the contact surfaces 15 and 16 of the yoke surfaces of corresponding or associated electromagnet coil cores. The armature 9 includes, opposite such pole surfaces (not shown) of electromagnet coil cores, a section 17. The armature section 17 is thicker than another section 9*a*, the thickness of the section 9*a* being selected so as to enable, if desired, the attachment thereto of a print element, as for example a print pin 18.

The outermost sheet-metal part 3 preferably carries no projections 8 for which purpose, as previously noted, the shaped openings 6 in the first part 3 comprise continuous throughbores into which the projections 8 of the next inner or adjacently-disposed sheet-metal part 1 nestedly engage without protruding beyond the outer face thereof.

While there have been shown and described and pointed out fundamental novel features of the invention as applied to preferred embodiments thereof, it will be understood that various omissions and substitutions and changes in the form and details of the device illustrated, and in its method of manufacture, may be made by those skilled in the art without departing from the spirit of the invention. It is the intention, therefore, to be limited only as indicated by the scope of the claims appended hereto.

What is claimed is:

1. A method of manufacturing an armature of an electromagnet-coil/armature system for a dot matrix print head wherein the armature includes a plurality of substantially flat, planar sheet-like elements disposed in a stack of said elements and forming substantially flat, planar side faces of the armature, comprising the steps of:

forming in a first face of each said sheet-like element a predeterminately shaped dimple-like indentation and, on a second face of each of at least all but one of said sheet-like elements, a dimple-like projection from said face in substantially coaxial alignment with said indentation, each said projection on said elements being predeterminately shaped to fit nestedly into the shaped indentation of another of said elements;

placing the plural sheet-like elements in side-by-side relation to form a stack of said elements wherein each said projection on one of the elements is nestedly received in one of said indentation in an element adjacently-disposed in the stack to provide form-locked mechanical connections between adjacently-disposed elements in the stack while defining with said first and second faces of the sheet-like elements the substantially flat, planar side faces of the armature; and securing the plural sheet-like elements in said stacked relation by bonding said elements one to another against loosening and disengagement of said form-locked mechanical connections, said bonding of said elements one to another comprising at least one of cementing and thermal bonding.

2. A method of manufacturing an armature in accordance with claim 1, wherein the predeterminately shaped indentation formed in one of said sheet-like elements comprises a predeterminately shaped throughbore extending between said first and second faces of said one element.

3. A method of manufacturing an armature in accordance with claim 1, wherein said forming of said indentations and projections is carried out substantially concurrently with forming of the sheet-like elements.

4. A method of manufacturing an armature in accordance with claim 1, wherein said forming of said indentations and projections is carried out substantially concurrently with forming of the sheet-like elements.

5. A method of manufacturing an armature in accordance with claim 1, wherein said bonding of the sheet-like elements comprises spot-wise thermal bonding of each two adjacently-disposed sheet-like elements of the stack between the first face of one said adjacently-disposed elements and the second face of the other of said adjacently-disposed elements.

6. A method of manufacturing an armature in accordance with claim 1, wherein the armature further includes a contact surface area which, during operation of the electromagnet-coil/armature system, contacts an electromagnet coil core, and wherein said bonding of the sheet-like elements is effected at a surface portion of the armature remote from said contact surface area.

7. An armature of an electromagnet-coil/armature system for a dot matrix print head, comprising:

a plurality of substantially flat, planar sheet-like elements, each of said elements having a predeterminately shaped dimple-like indentation defined in a first surface of the element, and each of at least all but one of said elements having a dimple-like projection extending outwardly from a second surface of the element and substantially coaxially aligned with the indentation defined in the first surface of the element, each said projection on said elements being predeterminately shaped to fit nestedly into the shaped indentation of another of said elements;

said plural sheet-like elements being arranged in side-by-side relation to form a stack of said elements defining substantially flat, planar side faces of the armature and wherein each said projection on one of the elements is nestedly received in one of said indentations in an element adjacently-disposed in the stack to provide form-locked mechanical connections between the adjacently-disposed elements in the stack; and bonding means substantially permanently securing said plural sheet-like elements in said stack so as to prevent loosening and disengagement of the form-locked mechanical connections between said elements, said bonding means comprising at least one of cementing and thermal welds between adjacently-disposed ones of said plural sheet-like elements in the stack.

8. An armature in accordance with claim 7, wherein the predeterminately shaped indentation defined in one of said sheet-like elements comprises a predeterminately shaped throughbore extending between said first and second surfaces of said one element.

9. An armature in accordance with claim 7, wherein said securing means comprises thermal bonds between said plural sheet-like elements.

10. An armature in accordance with claim 7, wherein said securing means comprises thermal spot welds between said plural sheet-like elements.

11. An armature in accordance with claim 7, wherein the armature further comprises a first section to which a print head element is securable and a second section of relatively greater thickness than said first section and including said form-locked mechanical connections between adjacently-disposed elements in the stack.

12. An armature in accordance with claim 7, wherein the predeterminately shaped indentation defined in one of said sheet-like elements comprises a predeterminately shaped throughbore extending between said first and second surfaces of said one element.

* * * * *